United States Patent [19]

Westervelt et al.

[11] 4,046,592

[45] Sept. 6, 1977

[54] WIRE CLEANING SYSTEM

[75] Inventors: Dean C. Westervelt, Acme; Luciano C. Scala, Murrysville; Howard E. Saunders, Pittsburgh; David F. Ciliberti, Murrysville, all of Pa.

[73] Assignee: Westinghouse Electric Corporation, Pittsburgh, Pa.

[21] Appl. No.: 648,431

[22] Filed: Jan. 12, 1976

[51] Int. Cl.[2] ..... B08B 3/10; B08B 3/12; C25F 1/00

[52] U.S. Cl. ..... 134/1; 134/2; 134/15; 204/141.5; 204/145 R

[58] Field of Search ..... 134/1, 2, 15, 30; 204/141.5, 145 R, 33, 211, 206, 207

[56] References Cited

U.S. PATENT DOCUMENTS

| | | | |
|---|---|---|---|
| 2,372,599 | 3/1945 | Nachtman | 134/15 X |
| 2,428,141 | 9/1947 | Burkhardt | 204/145 R X |
| 2,894,860 | 7/1959 | Engelhardt | 134/1 |
| 3,205,086 | 9/1965 | Brick et al. | 204/207 UX |
| 3,536,601 | 10/1970 | Hill et al. | 204/145 R X |
| 3,900,376 | 8/1975 | Copsey et al. | 204/141.5 |

*Primary Examiner*—S. Leon Bashore
*Assistant Examiner*—Marc L. Caroff
*Attorney, Agent, or Firm*—R. D. Fuerle

[57] ABSTRACT

Wire is cleaned by passing it through an electrolytic cleaner then through an ultrasonic rinse. The electrolytic cleaner comprises a graphite tube through which the wire passes, an alkaline aqueous solution between the wire and the graphite tube, and an electric current, at least half D.C., between the wire and the graphite tube.

11 Claims, 11 Drawing Figures

WIRE CLEANING SYSTEM

BACKGROUND OF THE INVENTION

Figure 1:
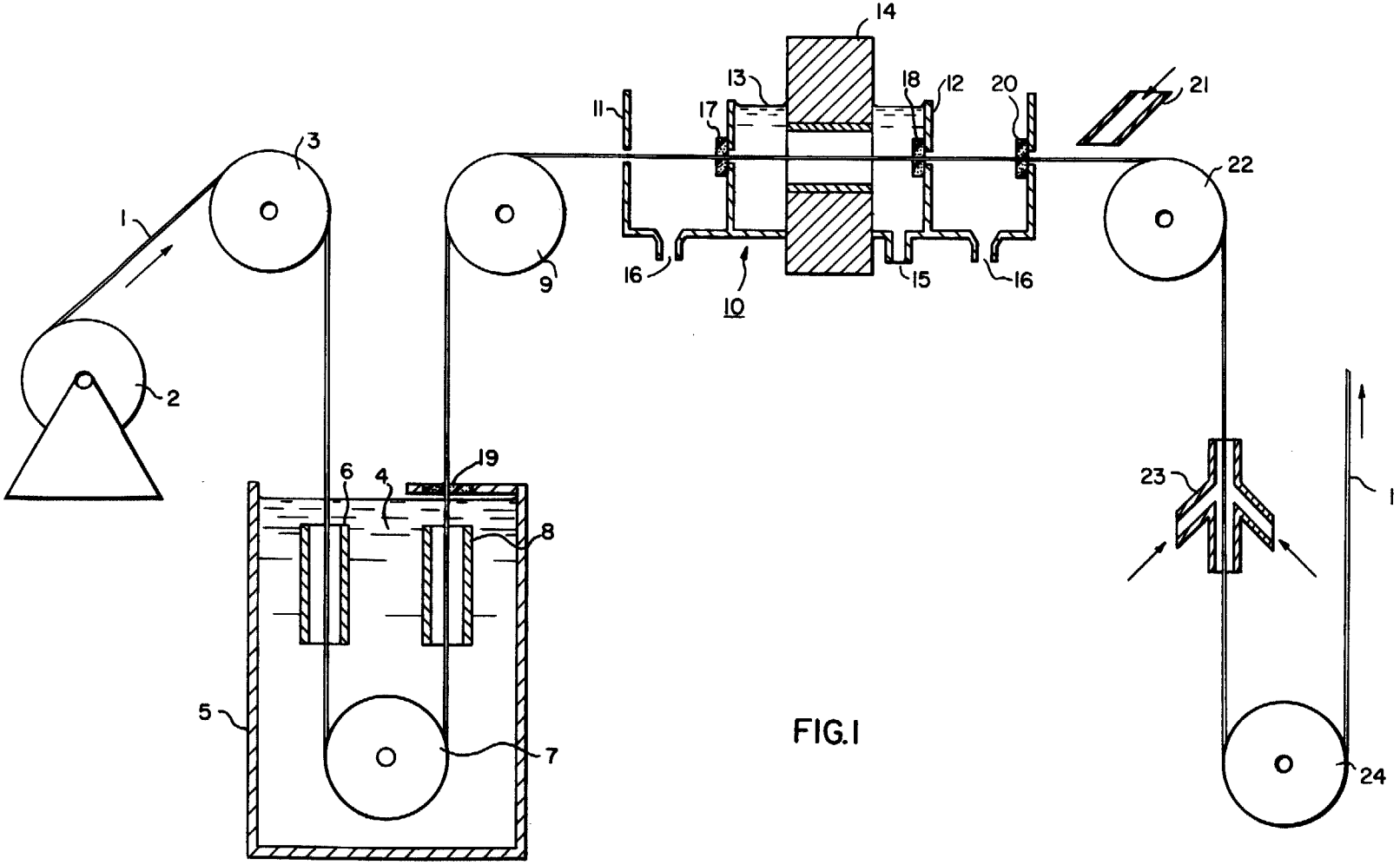

When wire is made, lubricants from the dies, dust, oxides, and other substances are left on the wire surface. If the wire is inadequately cleaned prior to being coated with an insulating composition, the insulation will not adhere well.

This is especially true of wire coated with powder in an electrostatic fluidized bed. Electrostatically coated wire is particularly sensitive to contaminating substances on the surface of the wire. Not only will contaminants cause poor adhesion, but they may also increase the rate of insulation shelf aging so that in a few months the insulation embrittles and breaks off. Because the thickness of powder coating on the wire is very sensitive to the strength of the electrostatic field around the wire, extraneous insulating or conducting substances on the wire surface may cause a non-uniform coating thickness.

Many methods have been tried to remove the large variety of contaminating substances which may be found on the surfaces of wire. These include acid and alkaline baths, pre-annealers, steel wool, and solvent-soaked rags. Some methods may be adequate for wires which will later be coated with enamel, but none have proved adequate for wire coated in an electrostatic fluidized bed.

PRIOR ART

U.S. Pat. Nos. 2,894,860 and 3,066,084 disclose the combination of an acid bath and an ultrasonic bath for cleaning wire.

U.S. Pat. No. 3,525,243 discloses ultrasonic wire cleaning.

U.S. Pat. Nos. 2,307,928, 3,287,238, and 3,630,864 disclose electrolytic cleaning of wire.

U.S. Pat. No. 3,041,259 discloses electrolytic cleaning of aluminum in an alkaline bath.

SUMMARY OF THE INVENTION

We have found that wire can be very effectively cleaned by passing it through a certain type of electrolytic bath then through an ultrasonic rinse. A wire cleaned according to this invention can be coated in an electrostatic fluidized bed without suffering the usually encountered problems of poor adhesion, rapid aging, and non-uniform thicknesses. Moreover, unlike acid baths sometimes used to clean wire, the electrolytic bath used in this invention is relatively safe.

DESCRIPTION OF THE INVENTION

The accompanying drawing is a schematic side view of a certain presently preferred embodiment of a wire cleaning system according to this invention.

In the drawing, wire 1 leaves pay-off 2 and passes over sheave 3 into electrolytic fluid 4 in tank 5. Sheave 3 gives the wire a good electrical ground-connection so that the wire remains electrically negative with respect to positively-charged graphite anode tube 6 through which the wire passes. The wire goes under sheave 7, through a second positively-charged graphite anode tube 8, over sheave 9, and through ultrasonic rinse 10. The ultrasonic rinse consists of a large tank 11 enclosing a smaller tank 12 which contains the water wash 13 and the ultrasonic transducer 14. The water wash enters inlet 15, overflows tank 12 and passes out drains 16. Sponges 17 and 18 act as seals and sponges 19 and 20 wipe excess fluid off the wire. Air wiper 21 blows excess water off the wire which then passes over sheave 22, through dry hot air blaster 23 which dries the wire, over sheave 24 and into the electrostatic fluidized bed (not shown).

The electrolytic fluid must be alkaline because acid baths do not saponify or easily emulsify the oils which are left on the wire when it is made. Thus, the fluid must have a pH above 7 and preferably between about 9 and about 11. The bath is an aqueous solution of an alkali metal or ammonium salt of a weak acid, or a mixture thereof. Hydroxides may also be used but are not preferred because they present safety problems and may corrode aluminum wire during periods of shutdown. Suitable weak acids include o-phosphoric, acetic, carbonic, and tartaric. Thus, the salts may include sodium phosphate, potassium acetate, ammonium carbonate, etc. Phosphates and carbonates are preferred as they are inexpensive yet effective. Preferably, at least 5% of the salts in the fluid are phosphates as they increase the conductivity of the fluid. The solids content of the fluid should be at least about 2%, as less has little effect. The upper limit on solids content may include as much as the water solubilities of each of the salts permits. About 5 to about 40% solids is preferred.

The tube which surrounds the wire in the electrolytic bath must be graphite, because other conductors become coated with a non-conducting film after a few hours of operation, and then are no longer effective in cleaning the wire. Graphite does not become coated with this non-conducting film, but instead gradually erodes away. How long a graphite tube lasts therefore depends primarily on its thickness, all other conditions being equal, but a tube whose walls are only ½ inch thick will normally last hundreds of hours, and graphite tubes are relatively inexpensive. A practical range of general tube dimensions for most purposes is at least about ⅛ inch wall thickness, about 2 to about 10 feet long, and an inside diameter sufficient to provide about ½ to about 1 inch clearance between the tube and the wire. While tubes are referred to as "graphite," they are usually made of a mixture of graphite and clay binder, and the term graphite is intended to include any conducting tube in which the primary conducting substance is graphite.

The graphite tube is preferably in a vertical position for several important reasons. First, in a horizontal tube the wire droops and therefore, because of its non-uniform distance from the tube wall, it will not be subjected to a uniform flow of current. Occasionally, contact between the wire and tube may also occur which may damage them. In a horizontal tube, bubbles, foam, and debris from tube wear tend to collect inside the tube and decrease current flow.

The current must be at least half direct current with the wire as the cathode and the tube as the anode, because if the wire is the anode it becomes coated with a non-conducting oxide film. While 100% direct current is preferred because of its greater efficiency, fluctuating D.C. or part A.C. may be used if desired. During the reverse portion of an A.C. cycle the wire will be oxidized and a portion of the D.C. current will then be required to remove the oxide. The current is preferably at least about 50 amp/ft$^2$, but the amount of current necessary to adequately clean the wire will depend upon the size and rate of travel of the wire, the clearance between the wire and the tube, the length of the tube, and the temperature of the bath. A practical range is typically about 100 to about 1000 amp/ft$^2$ for wire sizes greater than about No. 18 AWG (0.0403 inches in diameter).

The ultrasonic rinse is preferably horizontal as that arrangement presents fewer sealing problems. The water should flow countercurrent to the wire so that the cleanest water contacts the cleanest wire. An ultrasonic frequency range of from above audible sound to about 400 kilohertz may be used, though usually up to about 40 kilohertz is adequate.

The wire may be round, rectangular, or of other cross-sectional shape. It is usually copper or aluminum but other metals may also be cleaned using the invention. Wire speeds through the cleaning system may be selected as desired; speeds of 300 feet per minute are considered attainable.

The following example further illustrates this invention:

EXAMPLE

Using the apparatus shown in the drawing, 0.114 inch by 0.289 inch rectangular aluminum wire was run through a 160° F electrolytic fluid at 24 feet per minute. The fluid consisted of 15% sodium carbonate, 5% sodium phosphate, and 80% tap water. Each graphite tube was 24 inches long, 1½ inches I.D., and ¼ inches thick. A current of 270 amps at 15 volts was used.

An ultrasonic rinse followed the cleaning section, as shown in the drawing. The ultrasonic unit was at Westinghouse Cylsonic unit rated at 1 kw which operated at about 21 kHz and drew 16 A. The wire was powder coated electrostatically and exhibited excellent insulation adhesion and shelf life.

An earlier version of the above-described cleaning system, which had a horizontal electrolytic cleaner was used to clean several tons of 0.070 × 0.160 inch copper wire under conditions similar to those listed above at a wire speed of 33 ft/min. This wire was also powder coated electrostatically and exhibited excellent insulation adhesion and shelf life.

We claim:

1. A method of cleaning wire comprising
   1. passing said wire through a graphite tube;
   2. providing an alkaline aqueous solution between said tube and said wire;
   3. passing an electric current which is at least half direct current between said wire and said graphite tube with said graphite tube as the anode; and
   4. ultrasonically rinsing said wire.

2. A method according to claim 1 wherein said alkaline aqueous solution has a pH of about 9 to about 11 and is a solution of a water soluble compound selected from the group consisting of salts of a weak acid, a hydroxide, and mixtures thereof, at a concentration of about 2% up to the solubility in water of said compound.

3. A method according to claim 2 wherein said compound is about 0 to about 95% carbonate and about 5 to about 100% phosphate at a concentration of about 5 to about 40%.

4. A method according to claim 1 wherein said current is entirely a direct current.

5. A method according to claim 1 wherein said current is about 100 to about 1000 amps/ft$^2$.

6. A method according to claim 1 wherein the walls of said graphite tube are at least about ¼ inch thick, said tube is about 2 to about 10 feet long, and of sufficient inside diameter to provide a clearance between it and the wire of about ½ to about 1 inch.

7. A method according to claim 1 wherein said wire passes downwardly through a first vertical graphite tube, under a sheave, then upwardly through a second graphite tube.

8. A method according to claim 1 wherein said wire passes horizontally through said ultrasonic rinse.

9. A method according to claim 8 wherein in said ultrasonic rinse water moves in the direction opposite to that of said wire.

10. A method according to claim 1 wherein the frequency of said ultrasonic rinse is from above the frequency of audible sound to about 40 kilohertz.

11. A method according to claim 1 including drying said wire after it has passed through said ultrasonic rinse, and coating said wire in an electrostatic fluidized bed after it has been dried.

* * * * *